US009870762B2

(12) United States Patent
Benway et al.

(10) Patent No.: US 9,870,762 B2
(45) Date of Patent: Jan. 16, 2018

(54) STEERABLE LOUDSPEAKER SYSTEM FOR INDIVIDUALIZED SOUND MASKING

(71) Applicant: Plantronics, Inc., Santa Cruz, CA (US)

(72) Inventors: Evan Harris Benway, Santa Cruz, CA (US); Ken Kannapppan, Palo Alto, CA (US); Jacob T Meyberg, Santa Cruz, CA (US)

(73) Assignee: Plantronics, Inc., Santa Cruz, CA (US)

( * ) Notice: Subject to any disclaimer, the term of this patent is extended or adjusted under 35 U.S.C. 154(b) by 89 days.

(21) Appl. No.: 14/851,774

(22) Filed: Sep. 11, 2015

(65) Prior Publication Data

US 2017/0076708 A1 Mar. 16, 2017

(51) Int. Cl.
*H04R 3/02* (2006.01)
*G10K 11/175* (2006.01)

(52) U.S. Cl.
CPC ..... *G10K 11/175* (2013.01); *G10K 2210/111* (2013.01)

(58) Field of Classification Search
CPC ..... H04R 2203/12; H04R 2499/11; H04R 2201/401; H04R 1/406; H04R 29/001; H04R 3/005; H04R 1/40; H04R 2201/403; H04R 2410/01; H04R 2430/20; H04R 29/00; H04R 5/04; H04R 1/323; H04R 1/403; H04R 2205/022; H04R 3/12
USPC ..... 381/300, 92, 307, 122, 303, 56, 58, 17, 381/310, 94.2, 152, 18, 182, 19, 2, 304, 381/305, 306, 308, 309, 335, 59, 74, 77, 381/79, 99, 73.1, 7.1, 57, 104, 106, 86, 381/102, 103, 107, 108, 315, 71.1, 71.14, 381/71.4, 94.7, 983
See application file for complete search history.

(56) References Cited

U.S. PATENT DOCUMENTS

| | | | | |
|---|---|---|---|---|
| 5,649,061 | A | 7/1997 | Smyth | |
| 7,120,880 | B1 | 10/2006 | Dryer et al. | |
| 7,547,279 | B2 | 6/2009 | Kim et al. | |
| 7,813,840 | B2 | 10/2010 | Suyama et al. | |
| 8,620,319 | B1 * | 12/2013 | Thandu | H04W 48/02 370/331 |
| 2003/0107478 | A1 | 6/2003 | Hendricks et al. | |
| 2005/0135635 | A1 * | 6/2005 | Prince | H03G 9/005 381/86 |
| 2005/0200476 | A1 | 9/2005 | Forr et al. | |
| 2006/0109983 | A1 * | 5/2006 | Young | H04K 3/43 380/252 |

(Continued)

FOREIGN PATENT DOCUMENTS

WO WO 2015/061347 A1 4/2015

OTHER PUBLICATIONS

Benway et al., U.S. Appl. No. 14/833,386, filed Aug. 24, 2015, titled "Biometrics-Based Dynamic Sound Masking."

*Primary Examiner* — Akelaw Teshale

(57) ABSTRACT

Apparatus having corresponding computer-readable media and methods comprise a steerable loudspeaker system configured to produce sound based on audio delivered to the steerable loudspeaker system; a masking audio source configured to generate individualized masking audio based on preferences of a listener, and to deliver the individualized masking audio to the steerable loudspeaker system; and a controller configured to steer the steerable loudspeaker system based on a position of a listener.

18 Claims, 4 Drawing Sheets

(56) References Cited

U.S. PATENT DOCUMENTS

| | | | | |
|---|---|---|---|---|
| 2006/0262938 | A1* | 11/2006 | Gauger | G10L 21/02 381/56 |
| 2007/0121824 | A1 | 5/2007 | Agapi et al. | |
| 2007/0165812 | A1 | 7/2007 | Lee et al. | |
| 2008/0167878 | A1 | 7/2008 | Hause et al. | |
| 2011/0201960 | A1 | 8/2011 | Price et al. | |
| 2012/0237040 | A1* | 9/2012 | Holland | H04R 3/04 381/56 |
| 2012/0283593 | A1* | 11/2012 | Searchfield | H04R 25/75 600/559 |
| 2013/0019187 | A1 | 1/2013 | Hind et al. | |
| 2013/0156198 | A1* | 6/2013 | Kim | H04R 1/323 381/17 |
| 2013/0223658 | A1* | 8/2013 | Betlehem | H04S 3/002 381/307 |
| 2014/0064526 | A1* | 3/2014 | Otto | H04S 5/00 381/300 |
| 2015/0137998 | A1* | 5/2015 | Marti | B60Q 9/00 340/901 |
| 2015/0287421 | A1* | 10/2015 | Benway | H04K 3/43 704/226 |
| 2015/0382129 | A1* | 12/2015 | Florencio | H04S 7/303 381/303 |
| 2016/0125867 | A1* | 5/2016 | Jarvinen | G10K 11/175 381/73.1 |
| 2016/0234595 | A1* | 8/2016 | Goran | H04R 3/002 |
| 2017/0061951 | A1* | 3/2017 | Starobin | H04R 27/00 |

* cited by examiner

STEERABLE LOUDSPEAKER SYSTEM FOR INDIVIDUALIZED SOUND MASKING

FIELD

The present disclosure relates generally to the field of audio processing. More particularly, the present disclosure relates to sound masking.

BACKGROUND

This background section is provided for the purpose of generally describing the context of the disclosure. Work of the presently named inventor(s), to the extent the work is described in this background section, as well as aspects of the description that may not otherwise qualify as prior art at the time of filing, are neither expressly nor impliedly admitted as prior art against the present disclosure.

As real estate utilization increases and offices become more densely packed, speech noise is becoming an increasingly challenging problem. Overheard intelligible speech decreases productivity, speech privacy, and comfort.

Sound masking—the introduction of constant background noise in order to reduce speech intelligibility, increase speech privacy, and increase acoustical comfort—is increasingly being incorporated into offices as a solution. Sound masking generally relies on broadband sound such as filtered pink noise played by loudspeakers that may be located for example in the ceiling plenum.

Individuals have varying preferences with respect to masking sound level, type, and frequency, but existing sound masking systems cannot be personalized, and there are many cases in which users wish to be able to work productively without "walling themselves off" using a headset or headphones. And conventional loudspeaker sound masking systems cannot be adjusted based on a given individual's preferences without offending the preferences of others.

SUMMARY

In general, in one aspect, an embodiment features an apparatus comprising: a steerable loudspeaker system configured to produce sound based on audio delivered to the steerable loudspeaker system; a masking audio source configured to generate individualized masking audio based on preferences of a listener, and to deliver the individualized masking audio to the steerable loudspeaker system; and a controller configured to steer the steerable loudspeaker system based on a position of a listener.

Embodiments of the apparatus may include one or more of the following features. Some embodiments comprise a position system configured to determine the position of the listener. Some embodiments comprise a message system configured to deliver message audio to the steerable loudspeaker system, wherein the message audio represents a message for the listener. In some embodiments, the steerable loudspeaker system comprises one or more parametric loudspeakers each configured to provide an ultrasonic signal representing the individualized masking audio. In some embodiments, the steerable loudspeaker system comprises a plurality of loudspeakers each directed at a respective area; the controller is further configured to select one or more of the loudspeakers based on a position of a listener; and the controller is further configured to provide the individualized masking audio only to the selected one or more of the loudspeakers. In some embodiments, the steerable loudspeaker system comprises a loudspeaker, and a moveable support configured to move the loudspeaker in accordance with a control signal; and the controller is further configured to generate the control signal based on a position of a listener.

In general, in one aspect, an embodiment features a method comprising: generating individualized masking audio based on preferences of a listener; delivering the individualized masking audio to a steerable loudspeaker system; generating individualized masking sounds at the steerable loudspeaker system based on the individualized masking audio; and steering the steerable loudspeaker system based on a position of the listener.

Embodiments of the method may include one or more of the following features. Some embodiments comprise determining the position of the listener. Some embodiments comprise delivering message audio to the steerable loudspeaker system, wherein the message audio represents a message for the listener. Some embodiments comprise providing an ultrasonic signal representing the individualized masking audio. In some embodiments, the steerable loudspeaker system comprises a plurality of loudspeakers each directed at a respective area; and the method further comprises selecting one or more of the loudspeakers based on a position of a listener, and providing the individualized masking audio only to the selected one or more of the loudspeakers. In some embodiments, the steerable loudspeaker system comprises a loudspeaker, and a moveable support configured to move the loudspeaker in accordance with a control signal; and the method further comprises generating the control signal based on a position of a listener.

In general, in one aspect, an embodiment features computer-readable media embodying instructions executable by a computer to perform functions comprising: generating individualized masking audio based on preferences of a listener; delivering the individualized masking audio to a steerable loudspeaker system, wherein the steerable loudspeaker system generates individualized masking sounds based on the individualized masking audio; and steering the steerable loudspeaker system based on a position of a listener.

Embodiments of the computer-readable media may include one or more of the following features. Some embodiments comprise determining the position of the listener. In some embodiments, the functions further comprise: delivering message audio to the steerable loudspeaker system, wherein the message audio represents a message for the listener. In some embodiments, the functions further comprise: causing the steerable loudspeaker system to provide an ultrasonic signal representing the individualized masking audio. In some embodiments, the steerable loudspeaker system comprises a plurality of loudspeakers each directed at a respective area; and the functions further comprise selecting one or more of the loudspeakers based on a position of a listener, and providing the individualized masking audio only to the selected one or more of the loudspeakers. In some embodiments, the steerable loudspeaker system comprises a loudspeaker, and a moveable support configured to move the loudspeaker in accordance with a control signal; and the functions further comprise generating the control signal based on a position of a listener.

The details of one or more implementations are set forth in the accompanying drawings and the description below.

Other features will be apparent from the description and drawings, and from the claims.

Figure 1:
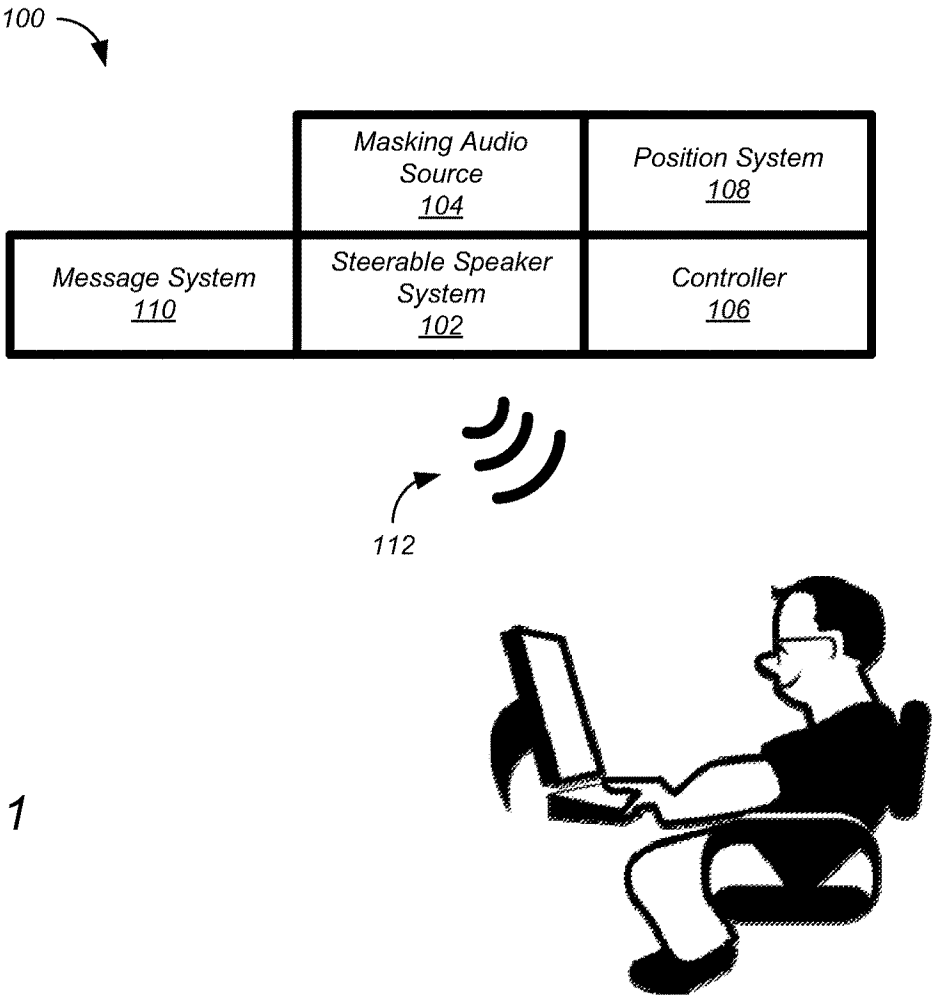
FIG. 1 shows elements of a sound masking system according to one embodiment.

The leading digit(s) of each reference numeral used in this specification indicates the number of the drawing in which the reference numeral first appears.

DETAILED DESCRIPTION

Embodiments of the present disclosure provide steerable loudspeaker systems for individualized sound masking. FIG. 1 shows elements of a sound masking system 100 according to one embodiment. Although in the described embodiment elements of the sound masking system 100 are presented in one arrangement, other embodiments may feature other arrangements. For example, elements of the sound masking system 100 may be implemented in hardware, software, or combinations thereof.

Referring to FIG. 1, the sound masking system 100 may include a steerable loudspeaker system 102, a masking audio source 104, a controller 106, a position system 108, and a message system 110. The masking audio source 104 may generate individualized masking audio 112 based on the preferences of a listener. As used herein, the term "audio" refers to signals representing sounds. The signals may be electronics, optical, or the like. The preferences may be established and stored in the masking audio source 104, the controller 106, elsewhere, or any combination thereof. The individualized masking sounds 112 may include any masking sounds. For example, the individualized masking sounds 112 may include pink noise, brown noise, filtered noise, nature sounds, sounds of certain locations, music, and the like.

The controller 106 may be implemented as one or more processors or the like. The position system 108 may employ any positioning technology. For example, the technologies may include ultra-wideband ranging, Bluetooth low-energy beaconing, received signal strength indications, fine timing measurement, global positioning systems, digital television signals, round-trip timing, time difference of arrival techniques, beacons at doorways, and the like. Beacons may be used to detect listeners passing through entryways, doors or known landmarks. Activity and motion tracking, for example using multi-axis motion detection, for example using accelerometers, gyroscopes, and the like in a mobile device, may be used to track movement from a known location.

Other positioning techniques such as 3D scanners and cameras, for example using RGB, depth sensors using infrared projectors or lasers, and multi-array microphones may be used for gesture, motion, facial, and voice recognition. Range cameras and imaging may be used to determine distance or depth to listeners. Several range cameras may be used in stereo as long as they share corresponding points in their images to help with triangulation. Such cameras do not need illumination to work and could be used even in particularly dim locations. Time of flight cameras using image sensors that gather 3D information by emitting a short laser pulse and intensified CCD (charge-coupled device) camera shutter may be used. The distance to the listener may be determined by measuring the time taken for a pulse of light to reflect off the listener and return to the sending device.

The message system 110 may be implemented as any system capable of generating audible messages. The messages may be intended for one or more individuals or groups. The sound masking system 100 may be implemented as any steerable loudspeaker system capable of delivering sound to a selected location. For example, the sound masking system 100 may be implemented as a plurality of individually-addressable loudspeakers, one or more moveable loudspeakers, a phased array of loudspeakers, or the like.

Figure 2:
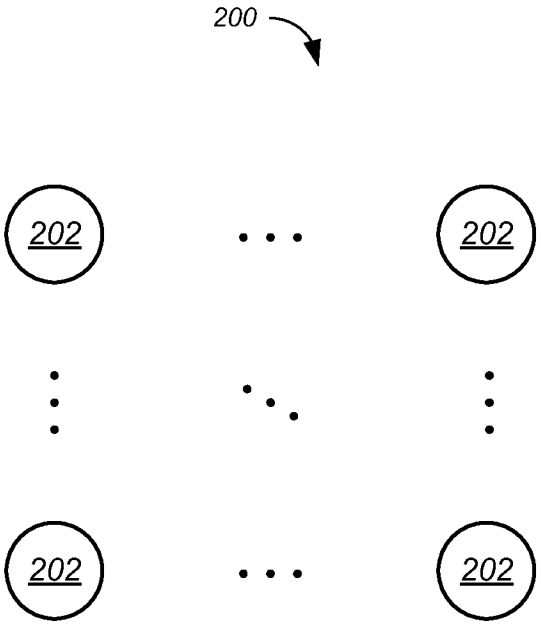
FIG. 2 shows an embodiment of the sound masking system of FIG. 1 that includes a plurality of loudspeakers.

In one embodiment, the sound masking system 100 may include a plurality of loudspeakers 202, as shown in FIG. 2. The loudspeakers 202 may be similar or different. While a two-dimensional array 200 of loudspeakers 202 is shown in FIG. 2, any configuration may be used. Each of the loudspeakers 202 is directed at a respective area. One or more of the loudspeakers 202 may be implemented as conventional loudspeakers or the like. One or more of the loudspeakers 202 may be implemented as parametric loudspeakers each configured to provide an ultrasonic signal representing the individualized masking audio. The controller 106 may select one or more of the loudspeakers 202 for delivery of individualized masking sounds 112 and/or messages to one or more individuals based on the position of one or more of the individuals.

Figure 3:
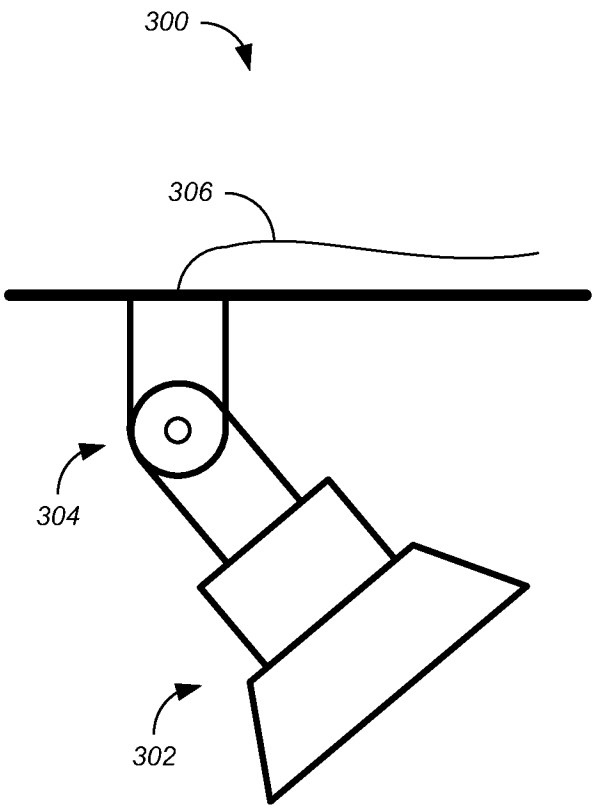
FIG. 3 shows an embodiment of the sound masking system of FIG. 1 that includes one or more moveable loudspeakers.

In one embodiment, the sound masking system 100 may include one or more moveable loudspeakers, as shown in FIG. 3. Referring now to FIG. 3, a moveable steerable loudspeaker system 300 may include a loudspeaker 302 and a moveable support 304. The loudspeaker 302 may be implemented as any loudspeaker. The loudspeaker 302 may be implemented as a conventional loudspeaker or the like. The loudspeaker 302 may be implemented as a parametric loudspeaker configured to provide an ultrasonic signal representing the individualized masking audio. The moveable support 304 may be implemented as any moveable support. For example, the moveable support 304 may be implemented as one or more motorized gimbals or the like. The moveable support 304 may be configured to move the loudspeaker 302 in accordance with a control signal 306. The control signal 306 may be generated by the controller 106 based on a position of one or more listeners.

Figure 4:
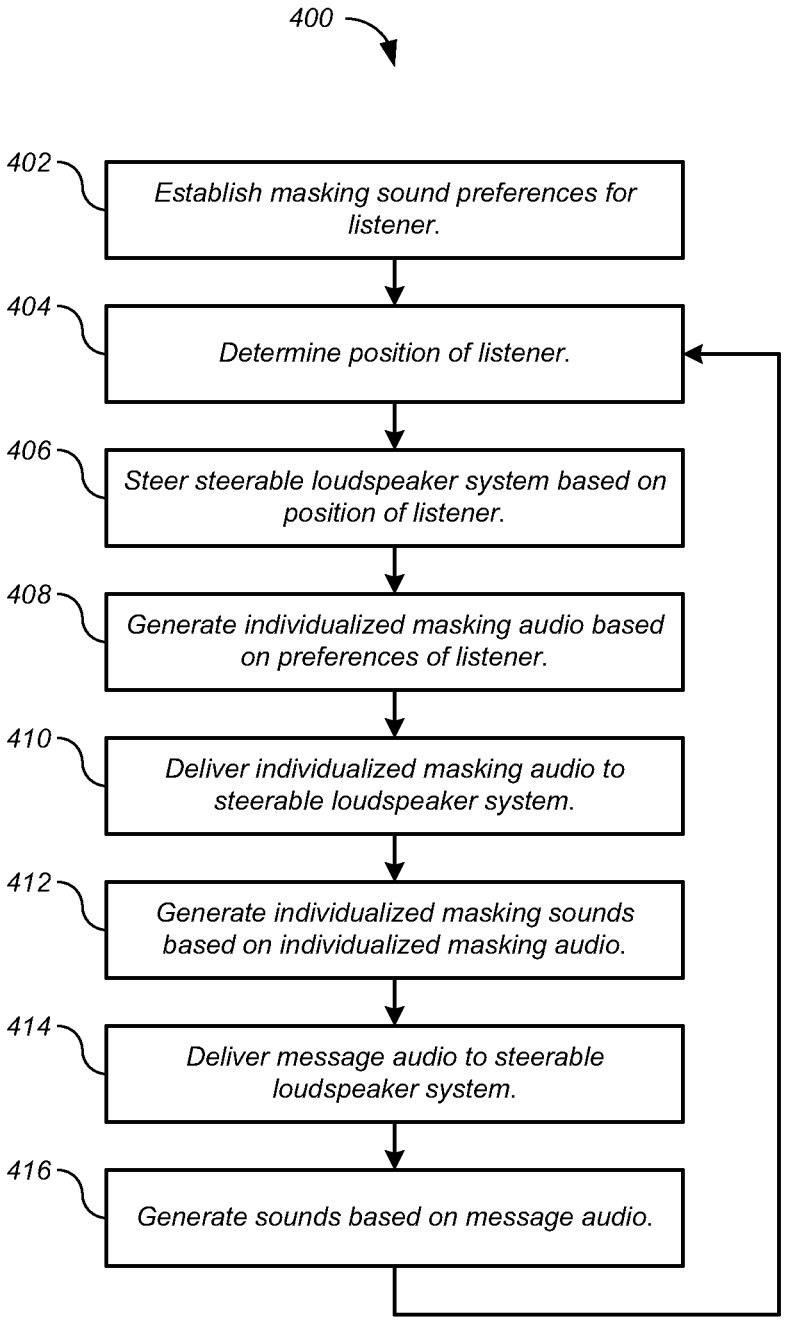
FIG. 4 shows a process for the sound masking system of FIG. 1 according to one embodiment.

FIG. 4 shows a process 400 for the sound masking system 100 of FIG. 1 according to one embodiment. Although in the described embodiments the elements of process 400 are presented in one arrangement, other embodiments may feature other arrangements. For example, in various embodiments, some or all of the elements of process 400 can be executed in a different order, concurrently, and the like. Also some elements of process 400 may not be performed, and may not be executed immediately after each other. In addition, some or all of the elements of process 400 can be performed automatically, that is, without human intervention.

Referring to FIG. 4, at 402, a listener may establish masking sound preferences. The listener may establish masking sound preferences by any method. For example, the listener may use a computer, smartphone, or other device to log in to a preferences server, which may present a form that allows the listener to select the preferences. The server may be hosted by the masking audio source 104, the controller 106, or elsewhere. The preferences may include types of masking sounds. For example, some listeners may prefer ocean sounds while others may prefer filtered pink noise. The preferences may include schedules for rendering the masking sounds, allowing listeners to specify different masking sounds on different days, at different times of day, and the like. The preferences may include locations, allowing listeners to specify different masking sounds, or no masking sounds, for different locations. Listeners may specify combinations of these preferences as well.

At 404, the position system 108 may determine the position of the listener. At 406, the controller 106 may steer the steerable loudspeaker system 102 based on the position of the listener. For example, in the embodiment of FIG. 2, the controller 106 may select one or more of the loudspeakers 202 based on the position of the listener, and may provide the individualized masking audio only to the selected loudspeaker(s) 202. As another example, in the embodiment of FIG. 3, the controller 106 may generate the control signal 306 based on the position of the listener, and the moveable support 304 may move the loudspeaker 302 in accordance with the control signal 306.

At 408, the masking audio source 104 may generate individualized masking audio based on the preferences of a listener. At 410, the individualized masking audio is delivered to the steerable loudspeaker system 102. At 412, the steerable loudspeaker system 102 generates individualized masking sounds 112 based on the individualized masking audio.

At 414, the message system 110 may deliver message audio to the steerable loudspeaker system 102. The message audio may represent a message for the listener. At 416, the steerable loudspeaker system 102 generates sounds based on the message audio.

The process may repeat, resuming at 404. In this manner, the masking sounds 112, messages, and the like may follow the listener as he moves from position to position while not disturbing other people located at other positions.

Various embodiments have many applications. For example, some embodiments may be used in a place of business to page an individual or provide location-specific audio. Such embodiments may allow an individual to hear information without having to wear a device, for example by allowing a sales agent to hear technical product information about a device while marketing the device to a buyer sitting across the table. In another example, a manager looking for an employee who is not at her desk could be paged with the present location of the employee.

In the home directional sound could replace speakerphones. Such embodiments may additionally play sounds or music based on the listener's location in the house or room without disturbing others. Such embodiments may allow several people to listen to different music or at different volumes based on their locations or preferences. Such embodiments may allow a listener to play video games without headphones while preventing the sound from bothering others in the room.

In a car, an audio system during a phone call could focus the sound to one or more individuals who desire to be involved in the call, thus creating additional acoustic privacy. In a retail or grocery store, personalized information could be communicated with a customer. Workers could be paged in a private manner without alerting or disturbing customers. In a museum, information about an exhibit could be directed at a patron based on his location and even the direction he is facing. An outside dining area could have music focused only at occupied tables and may allow different tables to listen to different music without imposing the music on other tables.

Some of these applications may be enhanced with the use of a microphone (perhaps clipped on to clothing or installed at a desk location) to allow for transmit communication as well. For example, a conferencing system may exist in the midst of an open office, with directional sound heard only by the listener on the call, and microphones tuned to pick up only the listener's voice.

Various embodiments of the present disclosure can be implemented in digital electronic circuitry, or in computer hardware, firmware, software, or in combinations thereof. Embodiments of the present disclosure can be implemented in a computer program product tangibly embodied in a computer-readable storage device for execution by a programmable processor. The described processes can be performed by a programmable processor executing a program of instructions to perform functions by operating on input data and generating output. Embodiments of the present disclosure can be implemented in one or more computer programs that are executable on a programmable system including at least one programmable processor coupled to receive data and instructions from, and to transmit data and instructions to, a data storage system, at least one input device, and at least one output device. Each computer program can be implemented in a high-level procedural or object-oriented programming language, or in assembly or machine language if desired; and in any case, the language can be a compiled or interpreted language. Suitable processors include, by way of example, both general and special purpose microprocessors. Generally, processors receive instructions and data from a read-only memory and/or a random access memory. Generally, a computer includes one or more mass storage devices for storing data files. Such devices include magnetic disks, such as internal hard disks and removable disks, magneto-optical disks; optical disks, and solid-state disks. Storage devices suitable for tangibly embodying computer program instructions and data include all forms of non-volatile memory, including by way of example semiconductor memory devices, such as EPROM, EEPROM, and flash memory devices; magnetic disks such as internal hard disks and removable disks; magneto-optical disks; and CD-ROM disks. Any of the foregoing can be supplemented by, or incorporated in, ASICs (application-specific integrated circuits). As used herein, the term "module" may refer to any of the above implementations.

A number of implementations have been described. Nevertheless, various modifications may be made without departing from the scope of the disclosure. Accordingly, other implementations are within the scope of the following claims.

What is claimed is:

1. A sound masking system, comprising:

a steerable loudspeaker system, configured to produce masking sound based on audio delivered to the steerable loudspeaker system;

a preferences server, configured for allowing a listener to establish individualized masking sound preferences;

a masking audio source, configured to generate individualized masking audio based on the masking sound preferences of the listener, and to deliver the individualized masking audio to the steerable loudspeaker system; and a controller configured to steer the steerable loudspeaker system based on a position of a listener, so that the masking sound is directed at the listener.

2. The sound masking system of claim 1, further comprising a position system configured to determine the position of the listener.

3. The sound masking system of claim 1, further comprising a message system configured to deliver message audio to the steerable loudspeaker system, based on the position of the listener.

4. The sound masking system of claim 1, wherein the steerable loudspeaker system comprises one or more parametric loudspeakers each configured to provide an ultrasonic signal representing the individualized masking audio.

5. The sound masking system of claim 1, wherein the steerable loudspeaker system comprises a plurality of loudspeakers each directed at a distinct area;

the controller is further configured to select one or more of the loudspeakers based on a position of a listener; and the controller is further configured to provide the individualized masking audio only to the selected one or more of the loudspeakers.

6. The sound masking system of claim 1, wherein the steerable loudspeaker system comprises a loudspeaker, and a moveable support, configured to move the loudspeaker in accordance with a control signal; and the controller is further configured to generate the control signal based on a position of a listener.

7. A method of providing individualized sound masking with a sound masking system, comprising:

querying a listener to establish individualized masking sound preferences;

generating individualized masking audio based on the masking sound preferences of the listener;

delivering the individualized masking audio to a steerable loudspeaker system;

generating individualized masking sound at the steerable loudspeaker system based on the individualized masking audio; and steering the steerable loudspeaker system based on a position of the listener, so that the masking sound is directed at the listener.

8. The method of claim 7, further comprising determining the position of the listener.

9. The method of claim 7, further comprising delivering message audio to the steerable loudspeaker system, based on the position of the listener.

10. The method of claim 7, further comprising providing an ultrasonic signal representing the individualized masking audio.

11. The method of claim 7, wherein the steerable loudspeaker system comprises a plurality of loudspeakers each directed at a distinct area; and the method further comprises selecting one or more of the loudspeakers based on a position of a listener, and providing the individualized masking audio only to the selected one or more of the loudspeakers.

12. The method of claim 7, wherein the steerable loudspeaker system comprises a loudspeaker, and a moveable support configured to move the loudspeaker in accordance with a control signal; and the method further comprises generating the control signal based on the position of the listener.

13. A non-transitory computer-readable media embodying instructions executable by a computer to perform functions, comprising:

querying a listener to establish individualized masking sound preferences;

generating individualized masking audio based on the masking sound preferences of the listener;

delivering the individualized masking audio to a steerable loudspeaker system to allow the generation of individualized masking sound; and steering the steerable loudspeaker system based on a position of the listener, so that the masking sound is directed at the listener.

14. The non-transitory computer-readable media of claim 13, wherein the functions further comprise determining the position of the listener.

15. The non-transitory computer-readable media of claim 13, wherein the functions further comprise delivering message audio to the steerable loudspeaker system, based on the position of the listener.

16. The non-transitory computer-readable media of claim 13, wherein the functions further comprise causing the steerable loudspeaker system to provide an ultrasonic signal representing the individualized masking audio.

17. The non-transitory computer-readable media of claim 13, wherein the steerable loudspeaker system comprises a plurality of loudspeakers each directed at a distinct area; and the functions further comprise selecting one or more of the loudspeakers based on a position of a listener, and providing the individualized masking audio only to the selected one or more of the loudspeakers.

18. The non-transitory computer-readable media of claim 13, wherein the steerable loudspeaker system comprises a loudspeaker, and a moveable support configured to move the loudspeaker in accordance with a control signal; and the functions further comprise generating the control signal based on a position of a listener.

* * * * *